US006385879B1

(12) United States Patent
Fisher

(10) Patent No.: US 6,385,879 B1
(45) Date of Patent: May 14, 2002

(54) ADAPTABLE AND REMOVABLE END LABELING APPARATUS FOR ROLLED-UP PLANS OR THE LIKE

(76) Inventor: Frederick D. Fisher, 2475 Interstate Cir., Pensacola, FL (US) 32526

( * ) Notice: Subject to any disclaimer, the term of this patent is extended or adjusted under 35 U.S.C. 154(b) by 0 days.

(21) Appl. No.: 09/251,708

(22) Filed: Feb. 17, 1999

(51) Int. Cl.[7] ..... G09F 3/00
(52) U.S. Cl. ..... 40/309; 411/508; 411/913
(58) Field of Search ..... 40/309; 283/117; 411/510, 508, 913

(56) References Cited

U.S. PATENT DOCUMENTS 279,192 A * 6/1883 Shepherd et al. ..... 40/309
285,755 A * 9/1883 Kidd ..... 40/309
290,151 A * 12/1883 Vandeventer ..... 40/309
1,865,908 A * 7/1932 Hengst ..... 40/309
2,537,184 A * 1/1951 Dunn ..... 40/309 X
3,592,407 A * 7/1971 Hagmann ..... 40/309 X
3,959,853 A * 6/1976 Talan ..... 411/510 X
4,471,547 A * 9/1984 Koslow ..... 40/309
4,745,696 A * 5/1988 Scouten ..... 40/309
4,810,144 A * 3/1989 Martelli ..... 411/510 X
5,310,298 A * 5/1994 Hwang ..... 411/510 X
5,909,991 A * 6/1999 Manion et al. ..... 411/510 X

* cited by examiner

*Primary Examiner*—Jack Lavinder
*Assistant Examiner*—William L. Miller

(57) ABSTRACT

An adaptable and removable end labeling apparatus for labeling tubular and rolled materials including a base having a first side and a second side and a center rod having one end affixed in the center of the first side. The second side is adapted for placement of labeling indices. A resiliently adaptable circumferential wedge member coupled to the center rod and radially projecting therefrom is provided for adaptably friction fit coupling to an inner circumferential wall of the tubular and rolled materials.

11 Claims, 3 Drawing Sheets

ADAPTABLE AND REMOVABLE END LABELING APPARATUS FOR ROLLED-UP PLANS OR THE LIKE

BACKGROUND OF THE INVENTION

1. Field of the Invention

The present invention relates to labels and, more particularly, to an adaptable and removable end labeling apparatus for tubular members or tubular and rolled materials, such as, without limitation, plans (blueprints) or the like.

2. General Background

Generally, construction companies, draftsmen, etc. to accumulate large volumes of plans (blueprints) for the construction of buildings, subdivisions and homes. When storing the plans (blueprints), typically, such plans are rolled-up to minimize the space requirements for the storage or filing of the plans. One of the biggest drawbacks is the retrieval of the rolled plans for a particular site because of the lack of indices.

Even if an adhesive label is placed on the rolled plan, as the plans are periodically viewed and subsequently re-rolled the adhesive label may not be readily visible. The PlanTag label is a product available for labeling rolled up plans. As illustrated in Enclosure (1), an undated publication, the PlanTag label is provided with a disc-shaped member having a tab projecting rearward from the outer perimeter edge of the disc-shaped member. Thereby, when the PlanTag label is attached to the rolled plan (blueprint), the tab is slid between the rolled paper. Since, the rolled plans may become loosely wound, the tab may slide out from between the rolled paper.

Several apparatus have been patented which use various friction fit couplings to carry out various tasks. However, none of these apparatuses are directed to an end labeling apparatus for tubular and rolled materials.

For example, U.S. Pat. No. 4,905,870, entitled "Combined Filter Housing And Extractor Therefor", issued to C. A. Mamolou, discloses a mechanism including a cylindrically-shaped housing that has an open end designed to receive a cover. The cover has an opening therein to receive a V-shaped extractor having an apex extending above the cover and integral resilient arms extending below the cover. When the arms are fully expanded, the filters are secured in place. When the arms are moved toward one another, the upper most filter is engaged. When removing the extractor with the cover, pressure exerted by the arms, permits this uppermost single filter to be removed from the storage housing.

U.S. Pat. No. 4,718,188 entitled "Ice Removal Device" issued to F. W. Roberts, discloses, a device with a main rod and vane holder mounted at one end having a base with a plurality of expanding arms or vanes for expanding or contracting to adjust to ice fishing holes of various diameters. The device is used to remove particles of ice from ice fishing holes.

U.S. Pat. No. 356,784, entitled "Cabinet for Paper sheets and Bags", and U.S. Pat. No. 342,101, entitled "Cabinet for Sanitary Paper", teach devices that move paper sheets by friction.

U.S. Pat. No. 2,434,454, entitled "Sheet Paper Dispenser" teaches a device with a friction roller on a rod for removing paper from within a casing.

SUMMARY OF THE PRESENT INVENTION

The preferred embodiment of the adaptable and removable end labeling apparatus of the present invention solves the aforementioned problems in a straight forward and simple manner. What is provided is an adaptable and removable end labeling apparatus for labeling tubular and rolled materials comprising: removable means for labeling having a first side and a second side wherein said second side is adapted for placement of labeling indices; a center rod having one end affixed in a center of said first side and a free end; and, resiliently adaptable circumferential wedge means coupled to said center rod and radially projecting therefrom for adaptably friction fit coupling to an inner circumferential wall of said tubular and rolled materials.

In view of the above, it is an object of the present invention to provide such a resiliently adaptable circumferential wedge means having a natural tendency to spring or bias radially outward to a fully radial position.

Another object of the invention is to provide an adaptable and removable end labeling apparatus with such a resiliently adaptable circumferential wedge means coupled to the center rod and radially projecting therefrom to a predetermined circumferential limit for adaptably friction fit coupling to an inner circumferential wall of a tubular member, without regard to the inner circumference of the tubular member within a range limited to the predetermined circumferential limit of the wedge means.

A further object of the present invention is to provide an adaptable friction fit coupling of the wedge means in a tubular member, such as, without limitation, rolled materials or blueprints, wherein such adaptable friction fit coupling of the wedge means in the tubular member, of rolled materials or blueprints, exerts a force by the wedge means on the tubular member's inner circumferential wall to assist in maintaining the rolled materials or blueprints essentially tightly rolled.

It is a still further object of the present invention to provide a resiliently adaptable circumferential wedge means having a plurality of spaced-apart, radially flexible extremities.

It is a still further object of the present invention to provide a wedge means having a plurality of spaced-apart, radially flexible vanes or feather-like structures which radially extend from said center rod to a predetermined outer circumferential limit when in a fully radial position.

In view of the above objects, it is a feature of the present invention to provide an adaptable and removable end labeling apparatus which is simple to use.

Another feature of the present invention is to provide an adaptable and removable end labeling apparatus which is relatively simple structurally and thus simple to manufacture.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 5:
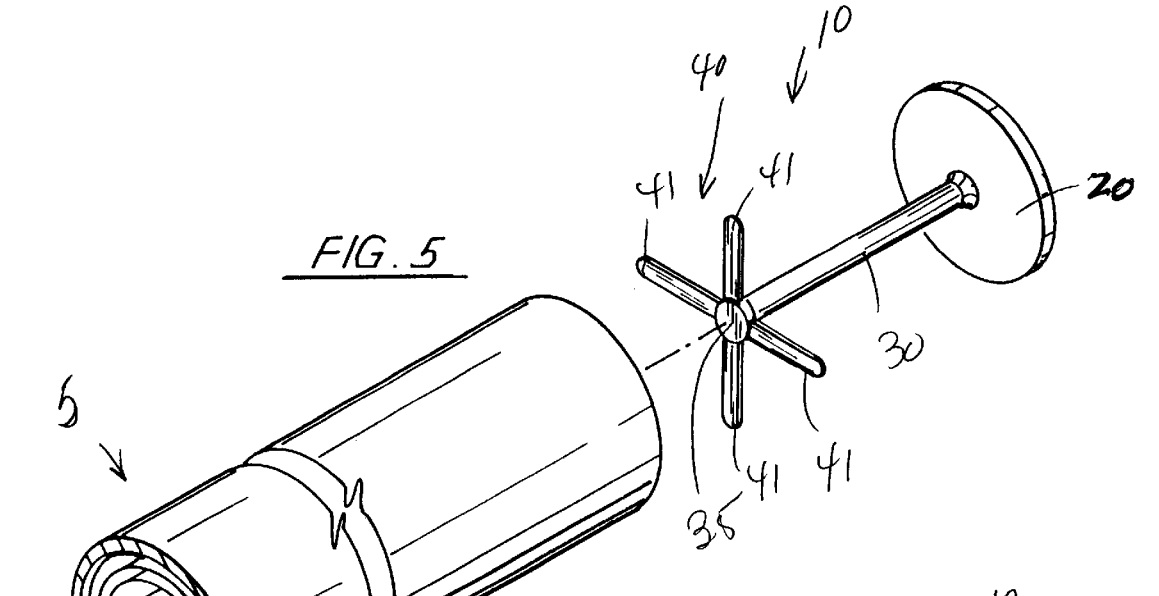
FIG. 5 illustrates an exploded view of the adaptable and removable end labeling apparatus of the present invention and a tubular and rolled materials.

Referring now to the drawing, and in particular FIGS. 1–4, the adaptable and removable end labeling apparatus of the present invention is designated generally by the numeral 10. Adaptable and removable end labeling apparatus 10 is generally comprised of disc-shaped base 20, cylindrical center rod 30 affixed in the center of one side 21 of disc-shaped base 20 and resiliently adaptable circumferential wedge means 40. The other (exterior) side 22 of disc-shaped base 20 serves as a surface for the placement of indices for labeling tubular and rolled materials 5 (FIG. 5).

Resiliently adaptable circumferential wedge means 40 is coupled to the free end 35 of cylindrical center rod 30 and radiates therefrom parallel to disc-shaped base 20 to define a predetermined outer circumferential limit L. The resilient properties of resiliently adaptable circumferential wedge means 40 allow wedge means 40 to be adaptably friction fit coupled in an open end of tubular and rolled materials 5, such as, without limitation, plans (blueprints), without regard to the inner circumference of the open end of the tubular and rolled materials within a range maximized by the predetermined outer circumferential limit L. The friction fit coupling of wedge means 40 is derived from its natural tendency to spring or bias radially outward to its fully radial position shown in FIG. 1.

As can be appreciated, the friction fit coupling serves to enhance the secure attachment of end labeling apparatus 10 to the open end of the tubular and rolled materials 5, especially, after long periods of storage of the tubular and rolled materials 5. The secure attachment of end labeling apparatus 10 via the friction fit coupling essentially prevents end labeling apparatus 10 from falling out of the open end of the tubular and rolled materials 5, even during transport. Furthermore, wedge means 40 exerts a force on the inner circumferential walls of the tubular and rolled materials 5 to maintain a relatively tightly wound roll as a result of the natural tendency of wedge means 40 to spring or bias radially outward to the fully radial position shown in FIG. 1. This exerted force by wedge means 40 to maintain the tubular and rolled materials 5 in a tightly wound roll is particularly advantageous since rolled plans (blueprints) tend to loosen because of the hollow core created when rolling up the plans. Typically, after the roller's hands are removed from the tubular and rolled materials 5, the hollow core is filled with the rolled materials thereby loosening the otherwise desirable tightly wound roll.

Since resiliently adaptable circumferential wedge means 40 serves to maintain the tubular and rolled materials 5 in a tightly wound roll, each of the open ends of the tubular and rolled materials 5 can have friction fit coupled therein my adaptable and removable end labeling apparatus 10.

The adaptability feature of the friction fit coupling allows wedge means 40 to readily adapt to a wide range of inner circumferences of the open end of the tubular and rolled materials 5. This is particularly advantageous, since the inner circumference of manually rolled materials cannot be know with any degree of certainty. Furthermore, such adaptability feature of wedge means 40 allows wedge means 40 to be easily retracted from the open end of the tubular and rolled materials 5, even after a long period of storage.

Figure 2:
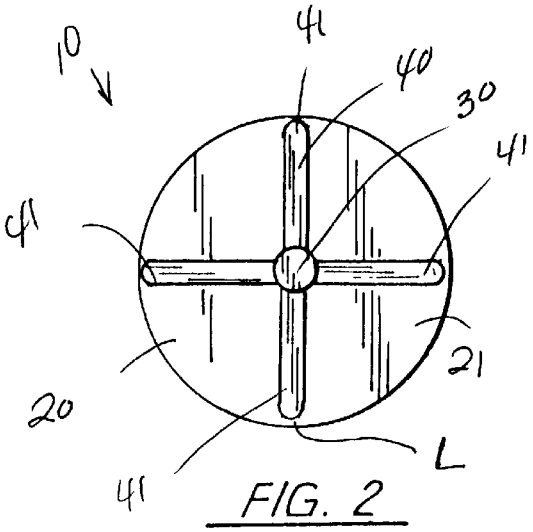
FIG. 2 is a front elevational view of the embodiment of FIG. 1.
Figure 3:
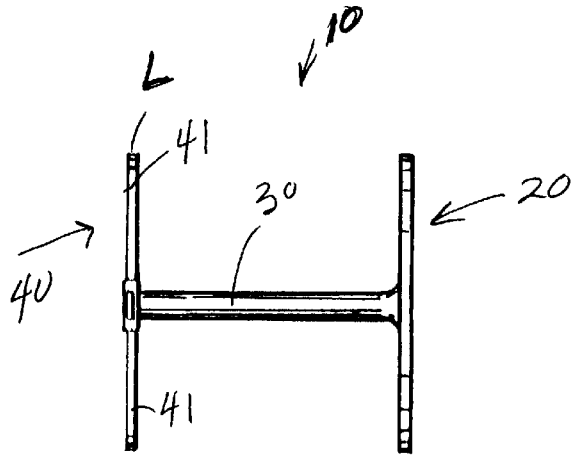
FIG. 3 is a right side elevational view of the embodiment of FIG. 1, the left side elevational, top plan and bottom plan views all being a mirror of that shown.
Figure 1:
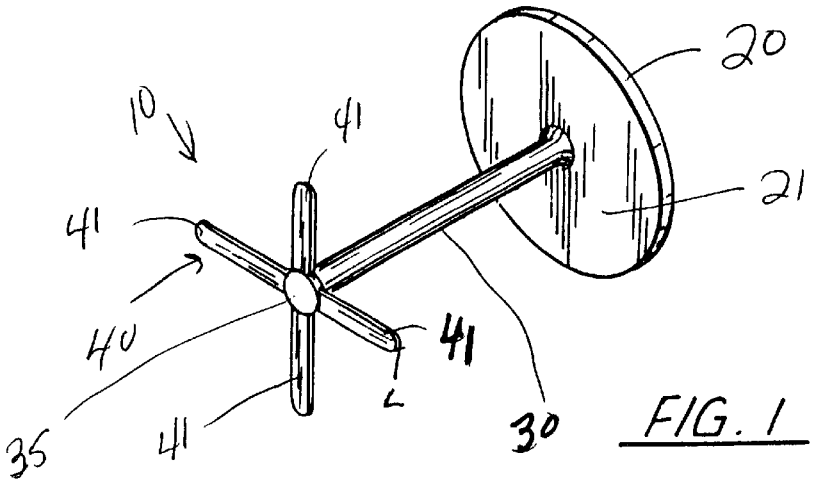
FIG. 1 is a top, front and right side perspective view of an adaptable and removable end labeling apparatus for the end of tubular and rolled materials showing my new design.
Figure 4:
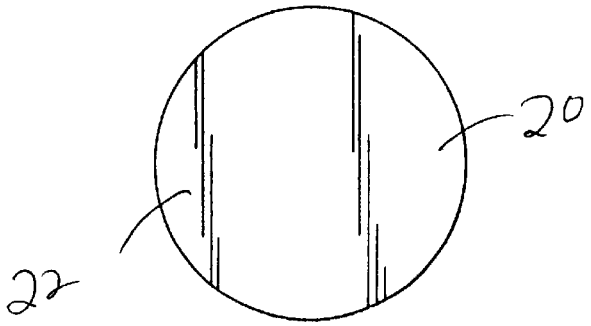
FIG. 4 is a rear elevational view of the embodiment of FIG. 1.

In the embodiment of FIGS. 1–4, resiliently adaptable circumferential wedge means 40 is a plurality of spaced-apart, radially flexible extremities 41 which are spring-like in nature in that they bend but bias or tend to return to their fully radial position defined by the predetermined outer circumferential limit L of FIG. 1. In the exemplary embodiment, there are four (4) radially flexible extremities 41 equally spaced apart. Nevertheless, the number of radially flexible extremities 41 and their spacing may vary.

In the exemplary embodiment, base 20 and rod 30 are made of generally rigid, thus sturdy, material, such as, without limitation, plastic, metal, or wood. However, the radially flexible extremities 41 are made of resiliently flexible material having spring-like properties.

Referring now to FIGS. 7–10, an alternate embodiment of my adaptable and removable end labeling apparatus is illustrated. Adaptable and removable end labeling apparatus 10' differs from the embodiments of FIGS. 1–4 in that resiliently adaptable circumferential wedge means 40' comprises a plurality of spaced-apart, radially flexible vanes 41' which are spring-like in nature in that they bend but bias or tend to return (spring) to their fully radial position defined by the predetermined outer circumferential limit L' of FIGS. 7 and 9. The radially flexible vanes 41' are similar in profile to that of vanes of an arrow or a feather.

In the exemplary embodiment, radially flexible vanes 41' slightly slope in the direction of base 20 and extend a longer distance down rod 30 then that of radially flexile extremities 41. As can be viewed, the profile of the radially flexible vanes 41' provides a larger surface area in surface-to-surface contact with the inner circumferential wall of the tubular and rolled materials 5. Therefore, the exerted force by wedge means 40' on the inner circumferential wall covers a larger surface area to maintain the tubular and rolled materials 5 in the desirable tightly wound roll.

Figure 6:
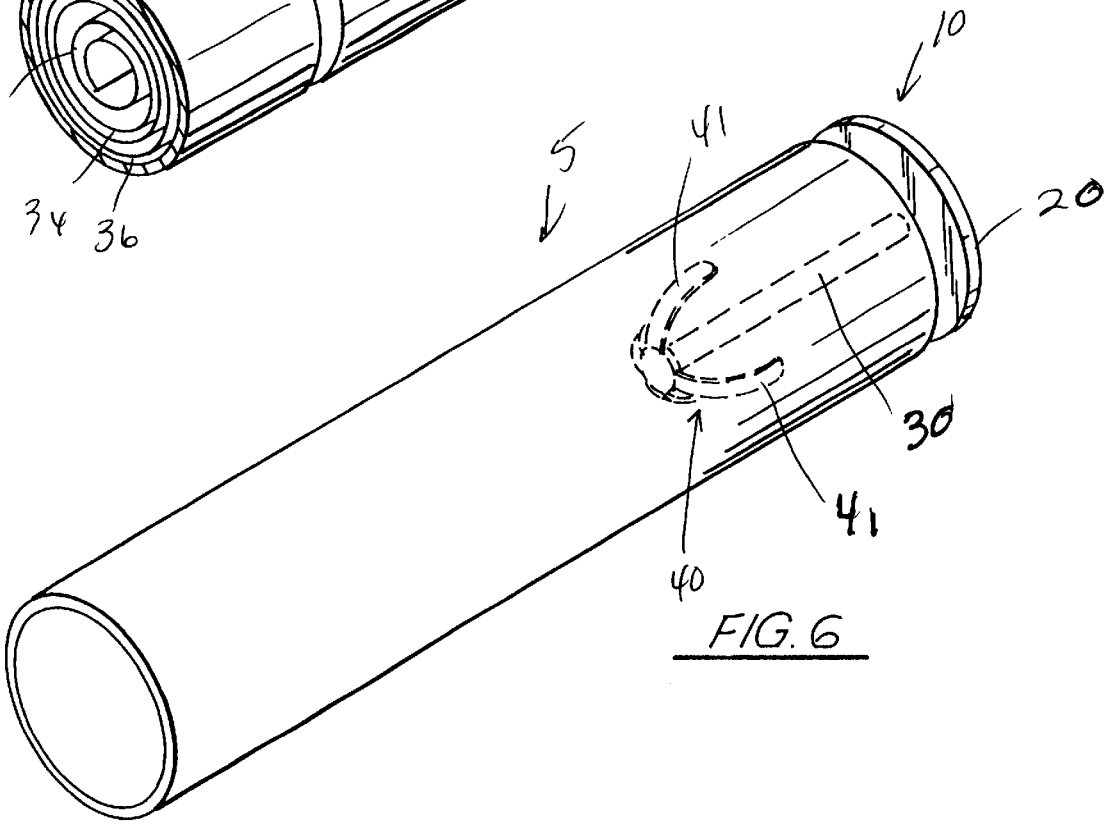
FIG. 6 illustrates, in phantom, the adaptable and removable end labeling apparatus of the present invention inserted in the tubular and rolled materials.
Figure 8:
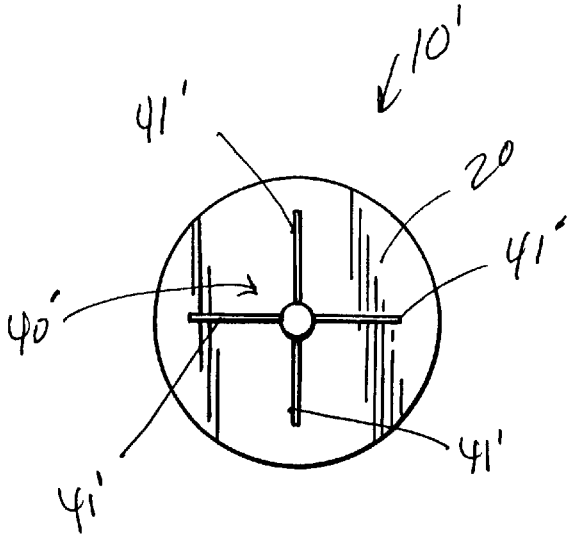
FIG. 8 is a front elevational view of the embodiment of FIG. 7.
Figure 9:
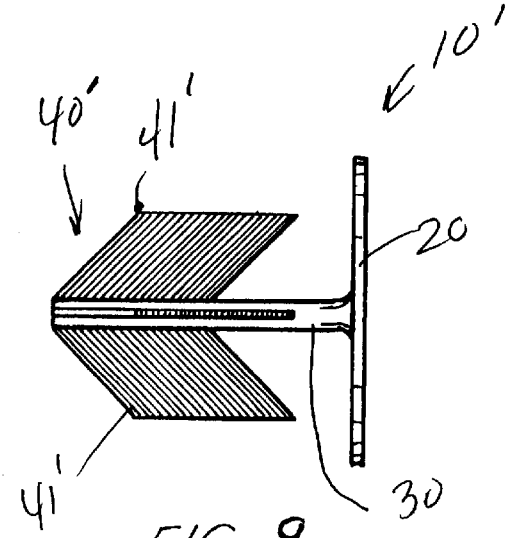
FIG. 9 is a right side elevational view of the embodiment of FIG. 7, the left side elevational, top plan and bottom plan views all being a mirror of that shown; and, FIG. 10 is a rear elevational view of the embodiment of FIG. 7.
Figure 7:
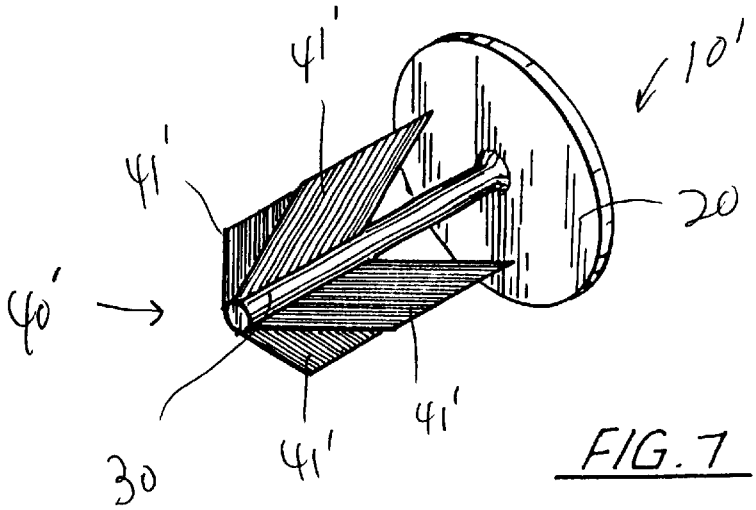
FIG. 7 is a top, front and right side perspective view of an alternate embodiment of the adaptable and removable end labeling apparatus for tubular and rolled materials showing an alternate new design.
Figure 10:
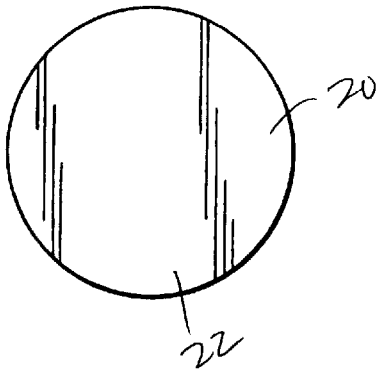

Since the operation of the embodiment of FIGS. 1–4 and the alternate embodiment of FIGS. 7–10 are essentially the same, only the operation of the end labeling apparatus 10 of FIGS. 1–4 will be described in detail, as best seen in FIGS. 5–6.

Referring now to FIGS. 5–6, end labeling apparatus 10 is preferably secure in tubular and rolled materials 5 (hereinafter sometimes referred to as "tightly wound roll 5"), such as, blueprint plans and the like. In the exemplary embodiment, tightly wound roll 5 includes a plurality of individual prints 32, 34, 36, etc., rolled into a tubular structure as best seen in FIG. 5. The free end 35 of rod 30 having coupled thereto wedge means 40 is slid into an open end of tightly wound roll 5 in the direction of ARROW 1. Preferably, end labeling apparatus 10 is slid into the open end of roll 5 until base 20 abuts the edge of roll 5. Optionally, the other open end of roll 5 may have slid therein another end labeling apparatus 10 in a direction opposite that of ARROW 1.

As rod 30 and wedge means 40 are slid into the open end of roll 5, the plurality of spaced-apart, radially flexible extremities 41 will resiliently flex or bend to adapt to the inner circumference of roll 5, as best seen in FIG. 6. Simultaneously, the plurality of spaced-apart, radially flexible extremities 41 automatically bias or spring toward the fully radial position shown in FIG. 5 until a friction fit coupling is had with the inner circumferential wall of roll 5. Thereby, end labeling apparatus 10 becomes secured in the roll 5. The force exerted by wedge means 40 serves to assist in maintaining roll 5 tightly wound in that the wound individual prints will not loosen in the otherwise hollow core of roll 5.

Any indices placed or the exterior side 22 of base 20 serves to label the roll 5 to identify the individual prints rolled in roll 5. For example, an adhesive label may be adhered to the exterior side 22 of base 20. Alternately, the exterior side 22 of base may be adapted to be directly written onto with any suitable writing implement.

End labeling apparatus 10 can be easily removed from roll 5 by simply pulling on base 20 in a direction opposite that of ARROW 1 to overcome the friction fit coupling of the plurality of spaced-apart, radially flexible extremities 40 with the inner circumferential wall of roll 5.

The embodiments described herein are primarily directed to rolled materials such as without limitations blueprints or the like. However, my end labeling apparatus 10 or 10' can be used with a tubular structure having a defined inner circumferential wall used to place and store therein rolled materials. For example, instead of using the end cap for closing the tubular structure, my end labeling apparatus 10 or 10' can be substituted. Thereby, the rolled materials placed in the tubular structure will maintain a relatively tightly wound roll.

The wedge means 40 or 40' of the exemplary embodiments include spaced-apart, radially flexible extremities 41 or vanes 41'. Nevertheless, the wedge means may have any contour, such as, disc-shaped, triangularly-shaped, star-shaped, etc., provided such contour adaptably flexes to create an adaptable friction fit coupling.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A system comprising an end labeling apparatus for labeling a tubular member in combination with said tubular member, said system comprising:

(a) said tubular member; and, (b) said end labeling apparatus, said apparatus comprising:

(i) a base having a first side and a second side wherein said second side is adapted for placement of labeling indices;

(ii) a center rod having one end affixed in a center of said first side and a free end; and, (iii) resiliently adaptable circumferential wedge means coupled to said center rod near said free end and radially projecting therefrom for adaptably friction fit coupling to an inner circumferential wall of said tubular member, wherein said tubular member comprises rolled materials in the shape of said tubular member and wherein said friction fit coupling of said wedge means in said tubular member, of said rolled materials, exerts a force by said wedge means on said inner circumferential wall to assist in maintaining said rolled materials essentially tightly rolled.

2. The apparatus of claim 1, wherein said base is disc-shaped.

3. The apparatus of claim 1, wherein said resiliently adaptable circumferential wedge means comprises a plurality of spaced-apart, radially flexible extremities.

4. The apparatus of claim 3, wherein said plurality of spaced-apart, radially flexible extremities radially extend from said center rod to a predetermined outer circumferential limit when in a fully radial position.

5. The apparatus of claim 4, wherein said base and center rod are made of rigid and sturdy material and said resiliently adaptable circumferential wedge means is made of resiliently flexible material so that said wedge means has a natural tendency to spring or bias radially outward to said fully radial position.

6. The apparatus of claim 1, wherein wedge means comprises a plurality of spaced-apart, radially flexible vanes or feather-like structures which radially extend from said center rod to a predetermined outer circumferential limit when in a fully radial position.

7. A system comprising an end labeling apparatus for labeling a tubular member having an inner circumference, in combination with said tubular member, said system comprising:

(a) said tubular member; and, (b) said send labeling apparatus, said apparatus comprising:

(i) a base having a first side and a second side wherein said second side is adapted for placement of labeling indices;

(ii) a center rod having one end affixed in a center of said first side and a free end; and, (iii) resiliently adaptable circumferential wedge means coupled to said center rod near said free end and radially projecting therefrom to a predetermined circumferential limit for adaptably friction fit coupling to an inner circumferential wall of said tubular member, without regard to said inner circumference of said tubular member within a range limited to said predetermined circumferential limit of said wedge means, wherein said tubular member comprises rolled materials in the shape of said tubular member and wherein said friction fit coupling of said wedge means in said tubular member, of said rolled materials, exerts a force by said wedge means on said inner circumferential wall to assist in maintaining said rolled materials essentially tightly rolled.

8. The apparatus of claim 7, wherein said resiliently adaptable circumferential wedge means comprises a plurality of spaced-apart, radially flexible extremities.

9. The apparatus of claim 8, wherein said plurality of spaced-apart, radially flexible extremities radially extend from said center rod to said predetermined outer circumferential limit when in a fully radial position.

10. The apparatus of claim 9, wherein said base and center rod are made of rigid and sturdy material and said resiliently adaptable circumferential wedge means is made of resiliently flexible material so that said wedge means has a natural tendency to spring or bias radially outward to said fully radial position.

11. The apparatus of claim 7, wherein wedge means comprises a plurality of spaced-apart, radially flexible vanes or feather-like structures which radially extend from said center rod to said predetermined outer circumferential limit when in a fully radial position.

* * * * *